US010687152B2

(12) United States Patent
Kuriger et al.

(10) Patent No.: US 10,687,152 B2
(45) Date of Patent: Jun. 16, 2020

(54) FEEDBACK DETECTOR AND A HEARING DEVICE COMPRISING A FEEDBACK DETECTOR

(71) Applicant: Oticon A/S, Smørum (DE)

(72) Inventors: Martin Kuriger, Berne (CH); Bernhard Kuenzle, Berne (CH); Meng Guo, Smørum (DE)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/176,862

(22) Filed: Oct. 31, 2018

(65) Prior Publication Data

US 2019/0132686 A1 May 2, 2019

(30) Foreign Application Priority Data

Nov. 1, 2017 (EP) ..... 17199523

(51) Int. Cl.
*H04R 25/00* (2006.01)
*H04R 3/02* (2006.01)

(52) U.S. Cl.
CPC ..... *H04R 25/453* (2013.01); *H04R 25/43* (2013.01); *H04R 25/505* (2013.01); *H04R 3/02* (2013.01); *H04R 2225/025* (2013.01)

(58) Field of Classification Search
CPC .... H04R 25/453; H04R 25/43; H04R 25/505; H04R 2225/025

(Continued)

(56) References Cited

U.S. PATENT DOCUMENTS

2009/0009251 A1* 1/2009 Speilbauer ..... H03G 3/00 330/278
2010/0260365 A1 10/2010 Petrausch (Continued)

FOREIGN PATENT DOCUMENTS

EP 2 003 928 A1 12/2008
EP 2 217 007 A1 8/2010

(Continued)

*Primary Examiner* — Sean H Nguyen
(74) *Attorney, Agent, or Firm* — Birch, Stewart, Kolasch & Birch, LLP

(57) ABSTRACT

A hearing device, e.g. a hearing aid, comprises an input transducer for providing an electric input signal representative of a sound in the environment of the hearing device, an output transducer for providing an output sound representative of said electric input signal, a signal processor operationally connected to the input and output transducers, and forming part of an electric forward path for processing said electric input signal and providing a processed electric output signal, and a feedback detector for providing first and second indications of current feedback in an external—acoustic and/or mechanical—feedback path from said output transducer to said input transducer.

The feedback detector is configured to determine the first and second indications of current feedback, respectively, based on said electric input signal or a processed version thereof and—optionally—on a current open loop magnitude of a feedback loop defined by said forward path and said external feedback path. The first and second indications of current feedback are generated with first and second time constants, respectively, where the first time constant is larger than the second time constant. The application further relates to a method of estimating feedback in a hearing device.

21 Claims, 7 Drawing Sheets

(58) Field of Classification Search
USPC ..... 381/312
See application file for complete search history.

(56) References Cited

U.S. PATENT DOCUMENTS

| | | | | |
|---|---|---|---|---|
| 2012/0148078 | A1* | 6/2012 | Junius | H04R 25/70 381/318 |
| 2014/0307890 | A1* | 10/2014 | Zhou | H04R 3/002 381/71.11 |
| 2015/0023514 | A1* | 1/2015 | Shi | G10L 21/02 381/66 |
| 2015/0125015 | A1 | 5/2015 | Van Der Werf | |
| 2017/0156009 | A9 | 6/2017 | Natarajan | |

FOREIGN PATENT DOCUMENTS

| | | |
|---|---|---|
| EP | 3 139 636 A1 | 3/2017 |
| EP | 3 291 581 A2 | 3/2018 |

* cited by examiner

FEEDBACK DETECTOR AND A HEARING DEVICE COMPRISING A FEEDBACK DETECTOR

SUMMARY

The present disclosure relates to hearing devices, e.g. hearing aids, in particular to detection of feedback in such devices. The present disclosure in particular deals with a feedback detector configured to determine first and second (e.g. binary) indications of current feedback, respectively, based on an electric input signal from an input transducer or a processed version thereof and possibly other inputs, wherein the first and second indications of current feedback are generated with first and second processing delays, respectively, and where the processing delay of the first binary indication is larger than the processing delay of the second binary indication.

A hearing device:

In an aspect of the present application, a hearing device, e.g. a hearing aid, is provided. The hearing device comprises

- an input transducer for providing an electric input signal representative of a sound in the environment of the hearing device,
- an output transducer for providing an output sound representative of said electric input signal, and
- a signal processor operationally connected to the input and output transducers, and forming part of an electric forward path for processing said electric input signal and providing a processed electric output signal,
- a feedback detector for providing first and second indications of current feedback in an external—acoustic and/or mechanical—feedback path from said output transducer to said input transducer. The feedback detector comprises
  - first and second detectors for providing said first and second indications of current feedback, respectively, based on said electric input signal or a processed version thereof,
  - wherein said first and second indications of current feedback are generated with first and second time constants, respectively, and where the first time constant is larger than the second time constant.

Thereby improved feedback detection may be provided.

The first detector is generally slower to deliver an indication of current feedback than the second detector. The second indication is however generally more robust that the first indication. The first (slow) detector may be configured to partially base its (first) indication of current feedback on the second indication (fast) of current feedback. The reason for the different time constants of the first and second detectors may e.g. be due to processing, e.g. smoothing, deliberately introduced delays, etc.

In an embodiment, the hearing device is configured to provide that either the first indication of current feedback or the second indication of current feedback is active or actively used at a given point in time. The hearing device may be configured to provide that in a first specific mode of operation, only one of the first and second indications of feedback is actively used at a given point in time. The hearing device may be configured to provide that in a second specific mode of operation, the first as well as second indications of feedback are actively used at a given point in time, e.g. for different tasks.

In an embodiment, the hearing device is configured to provide that the output of the second detector is used as an input to the first detector. In an embodiment, the hearing device is configured to provide that a detection of feedback by the second detector triggers activation of the first detector. In an embodiment, the hearing device is configured to provide that the output value of the second detector activates (and initializes) the first detector. The hearing device may be configured to provide that the first indication of current feedback is dependent on the second indication of current feedback.

In an embodiment, the hearing device is configured to provide that the activation of the first detector disables the second detector.

In an embodiment, the hearing device comprises an open loop gain estimator configured to determine a current open loop magnitude of a feedback loop defined by said forward path and said external feedback path and to determine said first and/or second indications of current feedback, respectively, based on said electric input signal or a processed version thereof and on said current open loop magnitude.

In an embodiment, the open loop gain estimator is configured to determine the current open loop magnitude at time instant m as $$Lp\mathrm{Mag}(k,m)=\mathrm{Mag}(k,m)-\mathrm{Mag}(k,m_D),$$

where Mag(k,m) is the magnitude value of the electric input signal IN(k,m) or another signal of the forward path at time m, whereas $\mathrm{Mag}(k,m_D)$ denotes the magnitude of the electric input signal $\mathrm{IN}(k,m_D)$ one feedback loop delay D earlier. The open loop magnitude of a hearing device can be determined in a variety of ways. One possibility is disclosed in our co-pending European patent application 16186338.6 filed on 30 Aug. 2017 at the European Patent Office and having the title 'A hearing device comprising a feedback detection unit' (published as EP3291581A2).

The feedback loop delay D is in the present context taken to mean the time required for a signal to travel through the loop consisting of the (electric) forward path of the hearing device and the (acoustic) feedback path from output transducer to input unit of the haring device (as illustrated in FIG. 4). The loop delay is taken to include the processing delay d of the (electric) forward path of the hearing device from input to output and the delay d' of the acoustic feedback path from the transducer to the input of the hearing device, in other words, loop delay D=d+d'. At least an estimate of the feedback loop delay is assumed to be known, e.g. measured or estimated in advance of the use of the hearing device, and e.g. stored in a memory or otherwise built into the system. In an embodiment, the hearing device is configured to measure or estimate the loop delay during use (e.g. automatically, e.g. during power-on, or initiated by a user via a user interface). In an embodiment, the hearing device is configured to provide one value of loop magnitude (and possibly loop phase) for each time index m, or for each time period corresponding to a current feedback loop delay (D), i.e. at times m'=p·D, where p=0, 1, 2, . . . .

In an embodiment, the open loop gain estimator is configured to determine the loop phase LpPhase (in radian) at time instant m as $$Lp\mathrm{Phase}(k,m)=\mathrm{wrap}(\mathrm{Phase}(k,m)-\mathrm{Phase}(k,m_D)),$$

where wrap(.) denotes the phase wrapping operator, the loop phase thus having a possible value range of $[-\pi, \pi]$, and where Phase(k,m) and Phase $(k,m_D)$ are the phase value of the electric input signal IN, at time instant m and at one feedback loop delay D earlier, respectively.

In an embodiment, the hearing device is configured to provide that a variation of loop phase with time comprises specific characteristics that can be used for detecting feedback (or build-up of feedback). In an embodiment, such specific characteristics are a linearly increasing loop phase with time. Such characteristics may be implemented by applying a (small) frequency shift in the forward path (cf. e.g. unit FS in FIG. 3B).

In an embodiment, the first and/or second indications of current feedback, respectively, comprise first and/or second binary indications of current feedback (RobustDet, FastDet). In an embodiment, the first detector is configured to provide the first indication of current feedback based on a first input (I11) comprises the electric input signal or a processed version thereof, and optionally further inputs.

In an embodiment, the first and second detectors are configured to provide the first and second indications of current feedback, respectively, based on

- a first input (I11, I21) comprising the electric input signal or a processed version thereof, and on
- a second input (I12, I22) comprising the current open loop magnitude of a feedback loop defined by said forward path and said external feedback path.

The first and second detectors are configured to generate the first and second indications of current feedback with the first and second time constants, respectively. The first detector having a relatively large time constant is termed the 'robust feedback detector', whereas the second detector having the relatively smaller time constant is termed the 'fast feedback detector'. The second (fast) detector is configured to react faster to changes in the feedback path than the first (robust) detector. The first (robust) detector provides a more reliable indication of current feedback (avoiding reaction to short-term changes of the feedback path), whereas the second (fast) detector provides a fast indication of current feedback also in acoustic situations with relatively fast (e.g. short term) variations in the feedback path.

The term 'time constant' is in the present context (e.g. detectors) taken to include any reaction time (delay) due to the processing of the input signals which reflect the time elapsed before a given event in the input signal (e.g. an increase or decrease in level) is reflected in the relevant output (of the detector). Examples of such processing incurred delays may include averaging or smoothing over time and/or frequency, filtering, tracking, conversion from time to frequency domain (e.g. Fourier transform), etc.

In an embodiment, the first and/or second indications of current feedback, respectively, comprise first and second estimates of a current level of feedback (RobustDetLvl, FastDetLvl). In an embodiment, the first and/or second detectors comprise(s) respective level detectors for providing said first and second estimates of a current level of feedback. In an embodiment, the first and/or second indications of current feedback, respectively, comprise(s) first and/or second binary indications of current feedback and first and/or second estimates of a current level of feedback. In an embodiment, the first and second estimates of a current level of feedback can be interpreted as respective indicators of a strength or confidence level of the corresponding first and second binary indications of current feedback.

In an embodiment, the feedback detector comprises a third detector for providing a third binary indication of current feedback (Det) based on said electric input signal or a signal derived therefrom, and wherein said first input(s) (I11, I21) to said first and/or second detectors comprise(s) said third binary indication of current feedback (Det). In general, the electric input signal may be provided to the feedback detector as a time domain or a frequency domain signal, or as a processed version thereof. In an embodiment, the hearing device comprises an analysis filter bank for providing the electric input signal in a time frequency representation (frequency domain).

Some examples of processed versions of the electric input signal is (e.g. short-time) Fourier spectrum of the signal, a peakiness measure of the signal, a correlation measure, a feedback loop transfer function, etc. In an embodiment, the electric input signal or a processed version of the electric input signal is further processed (e.g. by arithmetical, logical operations, etc.) by a processor of the third detector. In an embodiment, the processor of the third detector is configured to apply a threshold to the processed electric input signal to provide a binary detection output (0 or 1) of the third detector (the third binary indication of current feedback).

The terms first and second binary indications of current feedback, are e.g. taken to mean first and second binary control signals, where the binary states of the signals indicate feedback above a certain threshold level and feedback below a certain threshold level, respectively. The threshold level is e.g. determined with a view to avoiding feedback howl. In an embodiment, the threshold level(s) is/are configurable, e.g. user configurable.

In an embodiment, the second detector is configured to provide the second indication ofcurrent feedback (FastDet, FastDetLvl) based on

- a first input (IN21) comprising said electric input signal or a processed version thereof,
- a second input (IN22) comprising said current open loop magnitude (LpMag; LPG) of a feedback loop defined by said forward path and said external feedback path, and
- a third input (I23) received from the first detector and being indicative of a confidence level of the first binary indication of current feedback.

In an embodiment, third input received from the first detector is equal to the first estimate of a current level of feedback or to a processed version thereof.

In an embodiment, the feedback detector comprises a processor (PRCS21) for determining an accumulated loop magnitude over time and/or frequency (AccLpMag) in dependence of current open loop magnitude (LpMag; LPG). In an embodiment, the second detector comprises said processor for determining an accumulated loop magnitude over time and/or frequency. In an embodiment, the second detector is configured to determine the second binary indication of current feedback and/or the second estimate of a current level of feedback in dependence of the accumulated loop magnitude. In an embodiment, the second detector comprises a processor configured to determine the accumulated loop magnitude over time and/or frequency based on the second input and optionally on the first and/or third inputs. In an embodiment, the processor is configured to determine a fast indication of feedback based on the first input (and optionally on the second and/or third inputs). In an embodiment, the second binary indication of current feedback is determined in dependence of the accumulated loop magnitude and the fast indication of feedback.

In an embodiment, the second detector is configured to determine the second estimate of a current level of feedback (FastDetLvl) in dependence of the accumulated loop magnitude (AccLpMag).

In an embodiment, the first detector comprises a processor (PRCS31) configured to smooth said first input (I11) comprising said electric input signal or a processed version thereof over time/and or frequency and to provide said first binary indication of feedback (RobustDet) based thereon.

In an embodiment, the first binary indication of feedback is equal to the smoothed version of the first input to the first detector (possibly subject to a threshold unit (=>output '1' for input values>THR, and '0' for values≤THR).

In an embodiment, the feedback detector comprises a processor (PRCS32) for smoothing the accumulated loop magnitude (AccLpMag; ALM) over time and/or frequency and providing a smoothed accumulated loop magnitude (SMALM). In an embodiment, the first detector comprises the processor for smoothing said accumulated loop magnitude over time and/or frequency.

In an embodiment, the first detector is configured to determine said first estimate of a current level of feedback (RobustDetLvl) in dependence of said smoothed accumulated loop magnitude (SMALM). In an embodiment, the first detector is configured to determine the first estimate of a current level of feedback (RobustDetLvl) in dependence of the smoothed accumulated loop magnitude (SMALM) and the first and second inputs (I11, I12) to the first detector.

In an embodiment, the hearing device comprises a controller (CTR) configured to control functionality of the hearing device based on or influenced by the first and second binary indications of current feedback (RobustDet, FastDet) and/or by the first and second estimates of a current level of feedback (RobustDetLvl, FastDetLvl). In an embodiment, the hearing device comprises a feedback reduction system configured to reduce or cancel feedback from the output transducer to the input transducer. In an embodiment, the controller is configured to control or influence the feedback reduction unit, e.g. an adaptation rate of an adaptive algorithm of a feedback estimation unit of the feedback reduction system, or an update frequency of filter coefficients of a variable filter of a feedback estimation unit of the feedback reduction system. In an embodiment, the controller is configured to control or influence whether or not to activate or deactivate the feedback reduction system. A feedback reduction system has been implemented in a number of ways in the prior art. An example of a feedback reduction system is e.g. described in our co-pending European patent application 16186507.6, published as EP3139636A1.

In an embodiment, the controller is configured to control functionality of the hearing device based on or influenced by the first and second binary indications of current feedback, e.g. by the first and second binary indications of current feedback and/or by the first and second estimates of a current level of feedback.

In an embodiment, the controller (CTR) is configured to provide that a detection of feedback by the first and second detectors trigger activation of respective first and second, different kinds of feedback handling actions, wherein the second kind of feedback handling actions are configured to have a larger and/or faster impact on reducing the feedback and/or on reducing the respective indication of current feedback than the first kind of feedback handling actions.

In an embodiment, the hearing device constitutes or comprises a hearing aid, a headset, an earphone, an ear protection device, a speakerphone or a combination thereof.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the input transducer comprises a microphone for converting an input sound to an electric input signal. In an embodiment, the hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature, see, e.g., [Brandstein & Ward; 2001] and the references therein. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering, computational and numerical advantages over a direct implementation in its original form.

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$ e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system. Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problem are telephony, public address systems, headsets, audio conference systems, etc. Adaptive feedback cancellation has the ability to track feedback path changes over time.

It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the feedback suppression system comprises a feedback estimation unit for providing a feedback signal representative of an estimate of the acoustic feedback path, and a combination unit, e.g. a subtraction unit, for subtracting the feedback signal from a signal of the forward path (e.g. as picked up by an input transducer of the hearing device). In an embodiment, the feedback estimation unit comprises an update part comprising an adaptive algorithm and a variable filter part for filtering an input signal according to variable filter coefficients determined by said adaptive algorithm, wherein the update part is configured to update said filter coefficients of the variable filter part with a configurable update frequency $f_{upd}$. In an embodiment, the hearing device is configured to provide that the configurable update frequency $f_{upd}$ has a maximum value $f_{upd,max}$. In an embodiment, the maximum value $f_{upd,max}$ is a fraction of a sampling frequency $f_s$ of an AD converter of the hearing device ($f_{upd,max}=f_s/D$). In an embodiment, the configurable update frequency $f_{upd}$ has its maximum value $f_{upd,max}$ in an ON-mode of operation of the anti-feedback system (e.g. the maximum power mode). In an embodiment, the hearing device is configured to provide that—in a mode of operation of the anti-feedback system other than the maximum power ON-mode—the update frequency of the update part is scaled down by a predefined factor X compared to said maximum update frequency $f_{upd,max}$. In an embodiment, the update frequency $f_{upd}$ in different ON-modes of operation (other than the maximum power ON-mode) is scaled down with different factors $X_i$, i=1, . . . , ($N_{ON}$−1), where $N_{ON}$ is the number of ON-modes of operation of the anti-feedback system.

The update part of the adaptive filter comprises an adaptive algorithm for calculating updated filter coefficients for being transferred to the variable filter part of the adaptive filter. The timing of calculation and/or transfer of updated filter coefficients from the update part to the variable filter part may be controlled by the activation control unit. The timing of the update (e.g. its specific point in time, and/or its update frequency) may preferably be influenced by various properties of the signal of the forward path. The update control scheme is preferably supported by one or more detectors of the hearing device, including a feedback detector according to the present disclosure, preferably included in a predefined criterion comprising the detector signal(s).

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. In an embodiment, the hearing device comprises a speakerphone (comprising a number of input transducers and a number of output transducers, e.g. for use in an audio conference situation), e.g. comprising a beamformer filtering unit, e.g. providing multiple beamforming capabilities.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing aids (e.g. hearing instruments), headsets, ear phones, active ear protection systems, speakerphones, etc., e.g. in handsfree telephone systems, teleconferencing systems, public address systems, karaoke systems, classroom amplification systems, etc.

A Method:

In an aspect, a method of detecting feedback in a hearing device is provided. The hearing device comprises

- an input transducer for providing an electric input signal representative of a sound in the environment of the hearing device,
- an output transducer for providing an output sound representative of said electric input signal, and
- a signal processor operationally connected to the input and output transducers, and forming part of an electric forward path for processing said electric input signal and providing a processed electric output signal is furthermore provided by the present application.

The method comprises

- providing first and second binary indications of current feedback in an external—acoustic and/or mechanical—feedback path from said output transducer to said input transducer,
- determining first and second indications of current feedback, respectively, based on said electric input signal or a processed version thereof,
- wherein said first and second binary indications of current feedback are generated with first and second time constants, respectively, where the first time constant is larger than the second time constant.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SrnartPhone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

DEFINITIONS

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing, devices, the output unit may comprise one or more output electrodes for providing electric signals (e.g. a multi-electrode array for electrically stimulating the cochlear nerve). In an embodiment, the hearing device comprises a speakerphone (comprising a number of input transducers and a number of output transducers, e.g. for use in an audio conference situation).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids, public address systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using, electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, in particular to feedback detection in hearing devices.

Feedback detection is an important part in acoustic feedback control. Typically, a compromise has to be made between detection speed and robustness. In the present disclosure, a feedback detection refinement concept that provides fast and robust feedback detection is presented. The result is e.g. obtained by post-processing of a traditional feedback detection and feedback loop magnitude information.

Figure 1A:
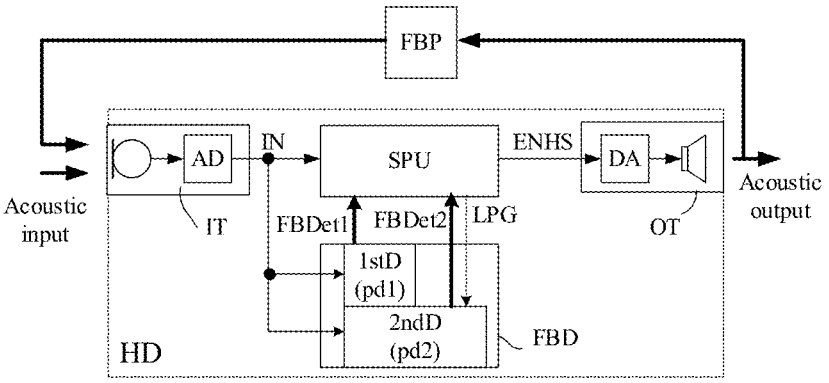
FIG. 1A shows a block diagram of a first embodiment of a hearing device comprising a feedback detector according to the present disclosure.

FIG. 1A shows a block diagram of a first embodiment of a hearing device comprising a feedback detector according to the present disclosure. The hearing device (HD), e.g. a hearing aid, comprises an input transducer (IT) for providing an electric input signal IN representative of a sound in the environment (Acoustic input) of the hearing device, and an output transducer (OT) for providing an output sound (Acoustic output) representative of said electric input signal IN. The hearing device (HD) further comprises a signal processor (SPU) operationally connected to the input and output transducers, and forming part of an electric forward path for processing said electric input signal IN and providing a processed electric output signal ENHS. The input transducer IT of the embodiment of FIG. 1A comprises a microphone for converting the acoustic input to an analogue electric input signal and an analogue to digital converter (AD) for converting the analogue electric input signal to digital electric input signal IN. Similarly, the output transducer (OT) comprises a digital to analogue converter (DA) for converting the digital processed electric output signal ENHS to an analogue electric output signal, and a loudspeaker for converting the analogue electric output signal to output sound (Acoustic output). The hearing device (HD) further comprises a feedback detector (FBD) for providing first and second indications (FBDet1, FBDet2) of current feedback in an external—acoustic and/or mechanical—feedback path (FBP) from said output transducer (OT) to said input transducer (IT). The feedback detector (FBD) comprises $1^{st}$ and $2^{nd}$ detectors (1stD, 2ndD) configured to determine the first and second indications (FBDet1, FBDet2) of current feedback, respectively, based on said electric input signal (IN) or a processed version thereof and optionally on a current open loop magnitude of a feedback loop defined by said forward path and said external feedback path (cf. clashed arrow and signal LPG from the signal processor (SPU) to the feedback detector (FBD)). The first and second indications (FBDet1, FBDet2) of current feedback are generated with first and second processing delays (pd1, pd2), respectively, where the first processing delay (pd1) is larger than the second processing delay (pd2). The first and second indications (FBDet1, FBDet2) of current feedback are fed to the signal processor/SPU), e.g. for use in controlling signal processing in the signal processor (SPU) or in other functional units (e.g. a feedback reduction system, cf. e.g. FIG. 1B, 1C or FIG. 3A, 3B) of the hearing device (and/or for being forwarded to a user interface for presentation to a user, cf. e.g. FIG. 6). The function of an embodiment of the feedback detector (FBD) is further described in connection with FIG. 2.

In an embodiment, the first and/or second indications (FBDet1, FBDet2) of current feedback comprise(s) binary indications (e.g. taking on values 0 or 1). In an embodiment, the first and/or second indications (FBDet1, FBDet2) of current feedback comprise(s) first and second estimates of a current level of feedback.

In an embodiment, the hearing device (HD) comprises a controller (cf. CTR in FIG. 3A, 3B) configured to control functionality of the hearing device based on or influenced by the first and second binary indications of current feedback and/or by the first and second estimates of a current level of feedback. In an embodiment, a combination of the first and second indications of current feedback (e.g. a combination of the binary indications of current feedback, and/or of the estimates of a current level of feedback) are used to control (qualify) a decision regarding a response of a processing algorithm to a change in the acoustic environment around the user.

The embodiment of a hearing device illustrated in FIG. 1A comprises a single input transducer. The hearing device may, however, comprise two or more input transducers (cf. e.g. FIG. 6), e.g. microphones, e.g. in the form of a microphone array. Additionally, the hearing device may comprise a beamformer filtering unit to provide a beamformed signal, e.g. as a combination of a multitude of electric input signals from a multitude of input transducers (e.g. microphones).

Figure 1B:
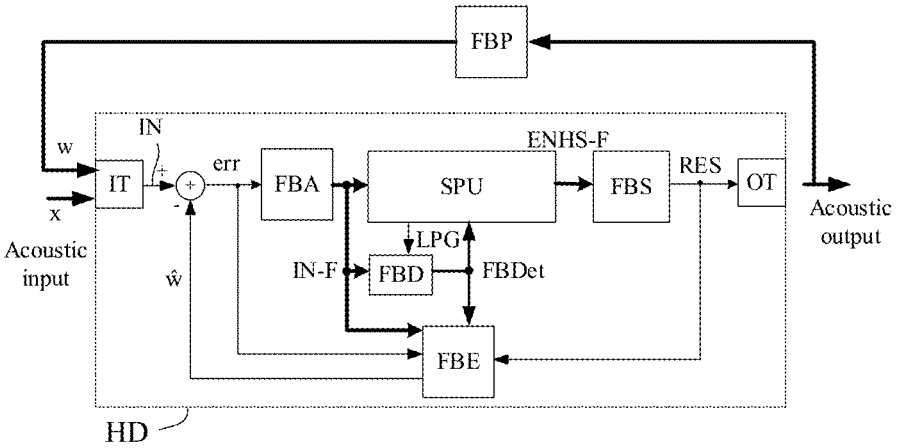
FIG. 1B shows a block diagram of a second embodiment of a hearing device comprising a feedback detector according to the present disclosure.

FIG. 1B shows a block diagram of a second embodiment of a hearing device (RD) comprising a feedback detector (FBD) according to the present disclosure. The embodiment of a hearing device illustrated in FIG. 1B comprises the same functional elements as the embodiment of illustrated in FIG. 1A. In the embodiment of FIGS. 1B (and 1C) the contributions to the acoustic input (Acoustic input) are specifically denoted w (feedback signal) and x (external signal), respectively. In addition, the embodiment of FIG. 1B comprises a feedback reduction system (FBE, '+') configured to reduce or cancel feedback from the output transducer (OT) to the input transducer (IT). The feedback reduction system comprises a feedback estimation unit (FBE) for estimating a current feedback from output transducer (OT) to input transducer (IT) through the feedback path (FBP, signal w) and providing a feedback estimate signal $\hat{w}$. The feedback cancellation system further comprises a combination unit (here summation unit '+') for combining the feedback estimate signal $\hat{w}$ with the electric input signal IN from the input transducer (IT) (here subtracting $\hat{w}$ from IN) to provide a feedback corrected signal err, which is fed to the signal processor (SPU, after appropriate conversion to frequency sub-band signals (IN-F) in analysis filter bank (FBA)) and to the feedback estimation unit (FBE). The feedback estimation unit (FBE) further receives the resulting output signal RES as an input to be able to estimate the external feedback path (e.g. by using an adaptive algorithm to minimize the error signal err in view of the current resulting output signal RES), and control input(s) FBDet from the feedback detector (FBD), e.g. for controlling the update of the feedback estimate (e.g. adaptation rate, update frequency, activation/deactivation, etc.). The embodiment of FIG. 1B comprises a filter bank in the forward path, the filter bank comprising respective analysis (FBA) and synthesis (FBS) filter banks. The analysis filter bank (FBA) and synthesis filter banks (FBS) are located in the forward path upstream and downstream of the signal processor (SPU), respectively, to allow at least a part of the processing of (at least) the forward path to be conducted in the (time-) frequency domain.

Figure 1C:
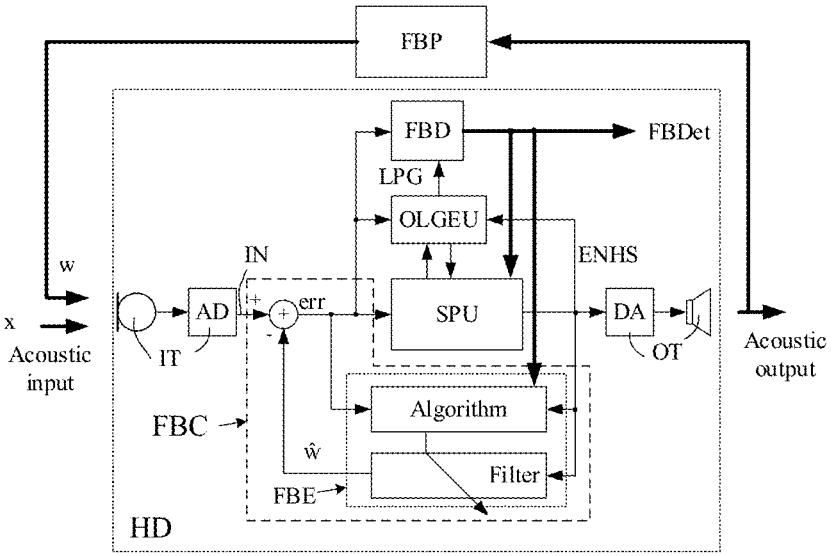
FIG. 1C shows a block diagram of a third embodiment of a hearing device comprising a feedback detector according to the present disclosure.

FIG. 1C shows a block diagram of a third embodiment of a hearing device comprising a feedback detector according to the present disclosure. The embodiment of a hearing device illustrated in FIG. 1C comprises the same functional elements as the embodiment of illustrated in FIG. 1A. In addition, the embodiment of FIG. 1C comprises a feedback reduction system configured (FBC, comprising units FBE, '+', as in FIG. 1B, cf. dashed enclosure) to reduce or cancel feedback from the output transducer (OT) to the input transducer (IT). In the embodiment of FIG. 1C, the feedback estimation unit (FBE) comprises an adaptive filter comprising an adaptive algorithm part (Algorithm) and a variable filter part (Filter). The filter part comprises e.g. a linear time invariant filter for filtering the output signal (ENHS) to provide the estimate $\hat{w}$ of the feedback path (FBP, represented by feedback signal w). The filter weights of the variable filter (Filter) are updated over time with filter coefficients determined by an adaptive algorithm (e.g. based on LMS, NLMS, etc.) of the algorithm part (Algorithm) to minimize the error signal err with respect to the reference signal (here output signal ENHS). In the embodiment of FIG. 1C, the feedback detector (FBD) receives as input the feedback corrected input signal err and an estimate of current loop gain LPG, and based thereon provides feedback detection signal(s) FBDet (cf. bold arrows denoted FBDet). The feedback detection signal(s) FBDet is/are fed to the signal processor (SPU), to the feedback enhancement unit (FBE, here specifically to the algorithm part (Algorithm)), and possibly to other functional units in the hearing device (HD) or other device(s) (e.g. to a contralateral hearing device of a binaural hearing system, e.g. a binaural hearing aid system, and/or to a remote processing and/or control device, e.g. a smartphone, cf. e.g. FIG. 6). The embodiment of FIG. 1C further comprises an open loop gain estimator (OLGEU) receiving as inputs one or more signals from the forward path (here feedback corrected signal err and processed signal ENHS, and possibly further inputs, e.g. from the signal processor (SPU)), which is/are used to provide an estimate of current open loop gain LPG. The estimate of current open loop gain LPG is used as input to the feedback detector (FBD) as discussed further in connection with FIG. 2, and may likewise be fed to the signal processor, e.g. for controlling a currently applied (maximum) gain. An estimator of current loop gain is e.g. described in EP2217007A1. The open loop gain estimator (OLGEU) may e.g. be configured to provide an estimate of a current loop magnitude and/or phase (e.g. including its variation over time, e.g. its time derivative). In an embodiment, the time variation of the open loop gain estimate (e.g. loop magnitude or loop phase) is used to identify build-up of feedback, e.g. by identifying characteristics in the time dependence of the parameter in question that can be associated with feedback.

Figure 2:
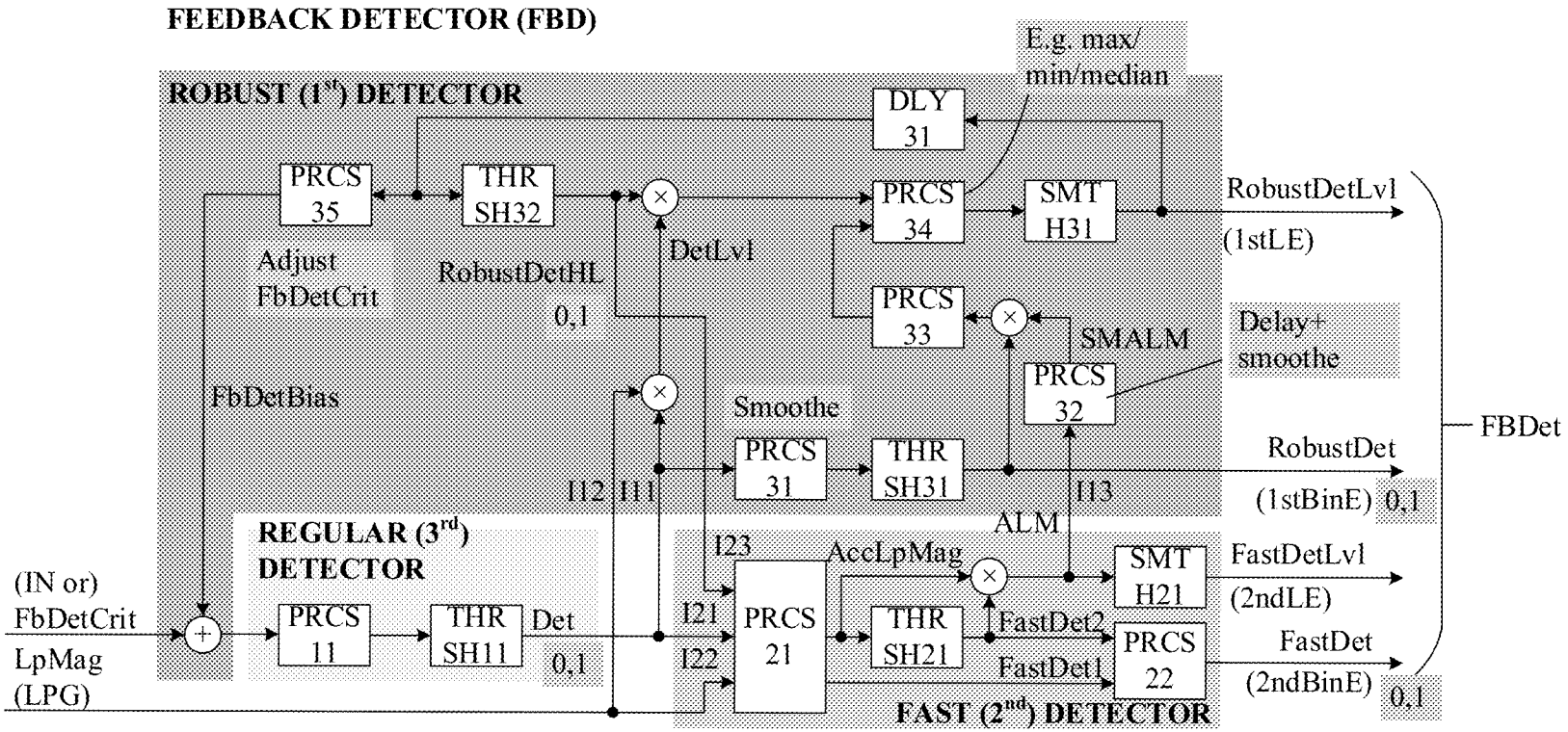
FIG. 2 shows a block diagram illustrating the processing per frequency channel in a feedback detector according to the present disclosure.

FIG. 2 shows a block diagram illustrating the processing per frequency channel in a feedback detector according to the present disclosure>. The block diagram can be divided into three parts. The "Regular Detection" part shows a typical feedback detector and it does not include any innovative element. The "Fast Detection" and "Robust Detection" parts are the innovative elements of the present invention disclosure. Both parts can be seen as post-processing upon regular detection.

The block diagram in FIG. 2 illustrates the processing per frequency channel. All signals are time-varying. The regular detection can be done by any of existing and known feedback detection algorithm/concept/method. To perform the additional "Fast detection" and "Robust detection" we make use of an additional feedback loop magnitude value (LpMag) indicating the open loop magnitude in the feedback loop. When the loop magnitude exceeds 1 (0 dB), there is very high risk for feedback. The signal LpMag can be a true value of the current open loop magnitude or an estimate of it.

Regular ($3^{rd}$) Detector

The regular detection part (Regular Detector in FIG. 2) takes one or more inputs suitable for detecting feedback, here termed 'feedback detection criteria', as input signals (cf. signal input FbDetCrit in FIG. 2). Some exemplary 'feedback detection criteria' can be an electric input signal (e.g. from an input transducer, e.g. a microphone, of the hearing device) itself, a short-time Fourier spectrum of the input signal, a peakiness measures of the signal, correlation measures, a feedback loop transfer function (e.g. a loop phase or a loop magnitude), etc.

These input feedback detection criteria are then processed by the block PRCS11. Exemplary processing performed in the processing block PRCS11 can be arithmetical, logical operations, e.g. combinations of different input criteria (if this, then . . . ), etc.

At the output stage of the Regular Detection part, a threshold is typically applied to the processed feedback detection criteria (cf. block THRSH11) to obtain binary detection output Det (e.g. 0 or 1 or HIGH or LOW, etc.) ('third binary indication of current feedback').

With this regular detection, an important and not completely trivial compromise between fast and robust detection typically has to be made.

Fast ($2^{nd}$) Detector

In fast detection part (Fast Detector in FIG. 2), a fast detection output "FastDet" (binary, e.g. 0 or 1) ('second binary indication of current feedback') and a numerical level "FastDetLvl" indicating the strength of the feedback are determined.

The processing block "PRCS21" combines the regular detection output "Det", an optional binary input "RobustDetHL" (0 or 1) from the block "Robust Detector" indicating high level of the robust detection, and the loop magnitude "LpMag", over time and/or frequency. The output of this block is an accumulated loop magnitude value (AccLpMag), over time and/or frequency. The accumulation is only conducted when "Det=1", and optionally only when "RobustDetHL=0", so that the accumulated loop magnitude is only available when the regular detection determines feedback and the robust detection is not active. Furthermore, an early fast detection output "FastDet1" is provided from this block to processing block "PRCS22". The detection "FastDet1" can be as fast as the regular detection "Det", and/or it can be further processed by "LpMag" and "RobustDetHL" signals.

The block "THRSH21" applies a threshold on the accumulated loop magnitude from the block "PRCS21" to obtain another early fast detection "FastDet2". The rationale behind this is that the feedback building-up situation can lead to a big value of accumulated loop magnitude, even though each individual loop magnitude value can be small. In this way, we can make a fast detection even before the feedback becomes noticeable. The fast feedback detection threshold is hence based on a loop magnitude threshold, such as . . . , −2, 0, 1, 2, . . . dB.

The fast detection output "FastDet" (0 or 1) is a result of the processing block "PRCS22" where the two early fast detections "FastDet1" and "FastDet2" are processed. Example processing can be min/max/median operations, logical operations etc. over time and/or frequency.

The smoothing operation block "SMTH21" takes the signal "AccLpMag" as the product of the fast detection "FastDet" and the accumulated loop magnitude "AccLpMag" from processing block "PRCS21" to determine the strength of the feedback "FastDetLvl". The smoothing operations, such as smoothing, filtering, tracking etc., can be done over time and/or frequency.

Robust ($1^{st}$) Detector

In the robust detection part (Robust Detector in FIG. 2), a robust detection output "RobustDet" (e.g. 0 or 1) ('first binary indication of current feedback') and a numerical level "RobustDetLvl" indicating the strength of the feedback are determined.

The blocks "PRCS31" and "THRSH31" combine the regular detection output "Det", over time and/or frequency, to determine a robust detection output "RobustDet" (0 or 1). As an example, the robust detection can be done by thresholding the number of detection counts (Det=1) in a time/frequency region. In this way, by taking more detection statistics into account, a more robust detection can be achieved (e.g. weighting, MIN, MAX, MEDIAN, quantile (e.g. percentile), etc.).

The block "PRCS32" takes the accumulated loop magnitude estimate "AccLpMag" and makes it more robust, by e.g. smoothing/filtering, over time and/or frequency.

The block "PRCS33" processes the product of "RobustDet" and the output of "PRCS32". This processing can, e.g., be a scaling, adding offset, etc. Its output is a candidate of robust detection level, which is fed into the block "PRCS34".

Another candidate of robust detection level is a modified version the detection level "DetLvl", which is the product of the output from the regular detection "Det" and the loop magnitude "LgMag". The signal "DetLvl" is relatively fluctuating and therefore it is multiplied to the binary signal "RobustDetHL" as the output from the block "THRSH32"; hence, we first make use of "DetLvl" when the "RobustDetLvl" is higher than a threshold value, e.g. . . . , −2,−1, 0, 1, 2 . . . dB.

The two candidate robust detection levels as the input to the processing block "PRCS34" are processed, by e.g., max/min/median operations, averaging, weighted sum, etc., before the block "SMTH31" further processes the output signal from "PRCS34", by e.g., filtering, smoothing, tracking, etc., over time and/or frequency to create the signal "RobustDetLvl" to indicate the strength of the feedback.

The signal "RobustDetLvl" is also used to adjust the feedback detection criteria as indicated by the block "PRCS35", which takes a delayed version of "RobustDetLvl", through the block "DLY31". Examples of adjustment can be adding an offset, by-passing some criteria etc.

The reason for this adjustment is that whenever a feedback takes place, it can potentially be beneficial to adjust the feedback criteria for a more robust detection. In particular, if an action to reduce feedback is taken based on outputs of the Robust detector ($1^{st}$ detector), RobustDet ($1^{st}$ binary detection of feedback) and/or RobustDetLvl signals ($1^{st}$ estimate of feedback level), and if this action is successful to reduce the level of feedback, it is proposed to modify one or more of the feedback criteria (e.g. embodied in signal FbDetCrit), e.g. to increase the sensitivity of the feedback detector (e.g. to provide a lower threshold level for indicating feedback, cf. e.g. FIG. 5B). An aim of the modification of the feedback criteria is to ensure that the decision to activate a feedback reduction scheme (e.g. to apply a frequency shift, to add probe noise, etc.) based on the signals from the Robust detector is not terminated (e.g. in that the feedback reduction scheme is removed/deactivated) too soon. In other words, the adjustment ('add an offset') introduces hysteresis in the change of outputs from the robust detector, cf. e.g. the example of FIG. 5B.

An example of this can be that when a spectral peakiness measure is used to determine feedback, and the robust detection level "RobustDetLvl" indicates that the feedback is on the limit to be detectable, it can be beneficial to add an offset to the feedback criteria to ensure a steady detection rather than a detection on/off over time due to the feedback is just around the feedback limit. Similar effect can be done by modifying the thresholds in the block "THRSH11" (in the Regular detector ($3^{rd}$ detector). However, in the present disclosure, the adjustment signal from block "PRCS35" is combined with (added to) input signal "FbDetCrit" rather than directly modifying feedback thresholds in "THRSH11".

In an embodiment, either the signal(s) provided by the $1^{st}$ (Robust) detector (the first indication of current feedback), or the signals provided by the $2^{nd}$ (fast) detector (the second indication of current feedback) is(are) active (or actively used) at a given point in time. In an embodiment, the feedback detector is configured to provide that a detection of feedback by the $2^{nd}$ (fast) detector triggers activation of the $1^{st}$ (Robust) detector. In an embodiment, the feedback detector is configured to provide that the activation of the (Robust) detector disables the $2^{nd}$ (fast) detector. In an embodiment, the feedback detector is configured to provide that a detection of feedback by the $2^{nd}$ (fast) detector triggers activation of a second kind of feedback handling actions. In an embodiment, the feedback detector is configured to provide that a detection of feedback by the $1^{st}$ (robust) detector triggers activation of a first kind of feedback handling actions. In an embodiment, first kind of feedback handling actions are different form the second kind of feedback handling actions. In an embodiment, the second kind of feedback handling actions are configured to have a larger and/or faster impact on reducing the feedback (e.g. the feedback detection measure, e.g. the indication of current feedback) than the first kind of feedback handling actions.

Figure 3A:
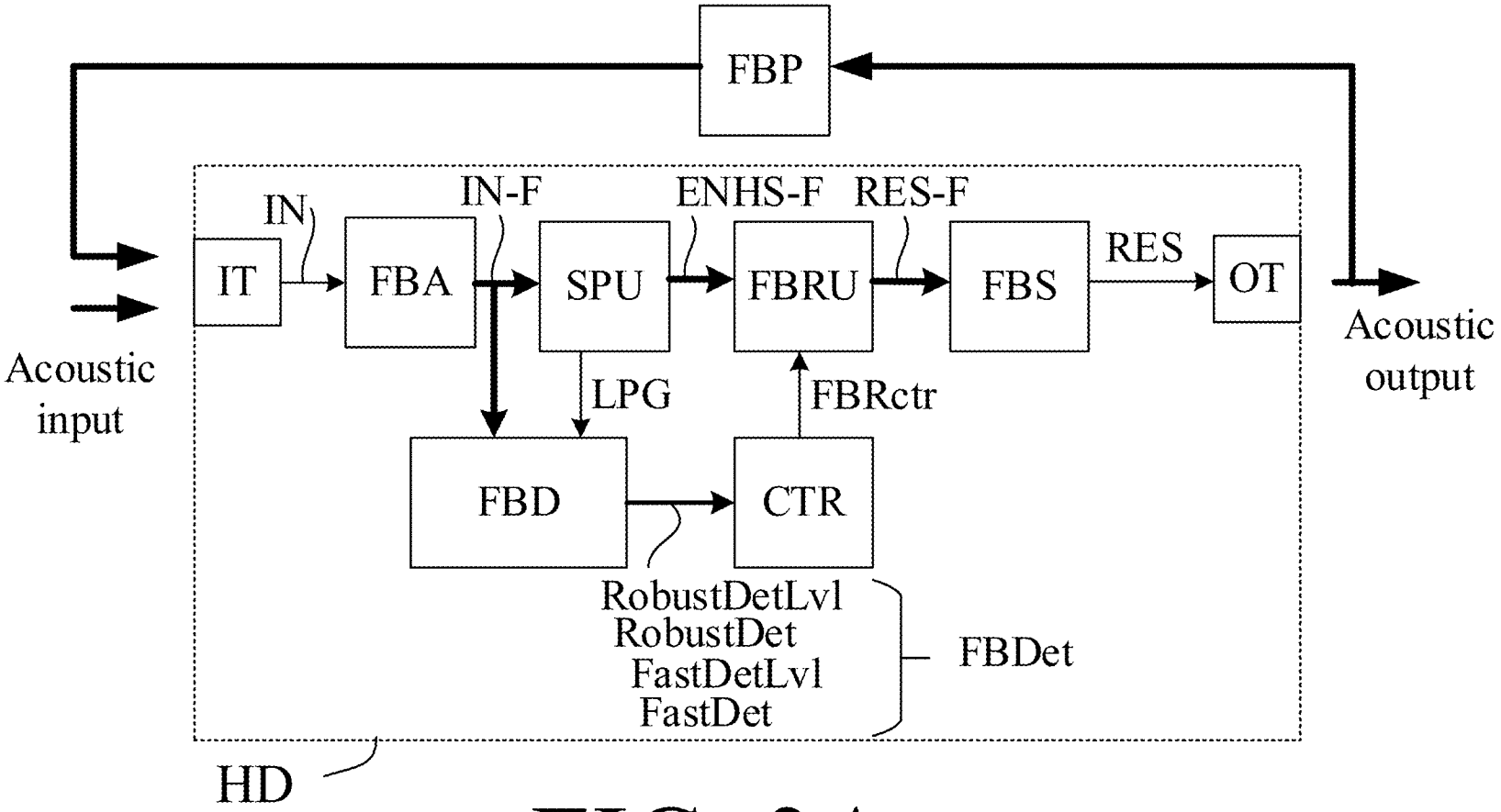
FIG. 3A shows a block diagram of a fourth embodiment of a hearing device comprising a feedback detector according to the present disclosure.

FIG. 3A shows a block diagram of a fourth embodiment of a hearing device comprising a feedback detector according to the present disclosure. FIG. 3A shows a hearing device (HD) comprising a forward path comprising an input transducer IT providing an electric input signal IN in the time domain, and an analysis filter bank (FBA) providing the electric input signal IN in a number of frequency bands (e.g. 4 or 8 or 64) as band split electric input signal IN-F. The forward path further comprises a signal processor (SPU) operationally coupled to the analysis filter bank (FBA) and configured to apply a requested forward gain to the band split electric input signal IN-F and to provide an enhanced band split signal ENHS-F. The forward path further comprises a feedback reduction unit (FBRU) for applying a gain modulation to the enhanced band split signal ENHS-F and providing a resulting band split signal RES-F with a reduced risk of creating feedback (i.e. reducing a risk of creating howl due to acoustic or mechanical feedback from the output to the input transducer). A feedback reduction unit for applying a gain modulation is e.g. disclosed in EP3139636A1. The forward path further comprises a synthesis filter bank (FBS) for generating a resulting time domain signal RES from the enhanced band split signal ENHS-F. The synthesis filter bank (FBS) is operationally coupled to an output transducer (OT, e.g. a loudspeaker or a vibrator) for converting the resulting time domain signal RES to an acoustic or vibrational stimulus for presentation to a user of the hearing device.

The hearing device (HD) further comprises a feedback detector (FBD) as described in the present disclosure. The feedback detector receives band split electric input signal IN-F from the forward path and an estimate of current open loop gain (signal LPG) from the signal processor (SPU) and provides outputs (RobustDetLvl, RobustDet) and (FastDetLvl, FastDet) indicative of current feedback, as e.g. described in connection with FIG. 2. The hearing device (HD) further comprises a controller (CTR) receiving the outputs of the feedback detector. The controller (CTR) is configured to control functionality of the hearing device based on or influenced by the first and second binary indications (RobustDet, FastDet) of current feedback and/or by the first and second estimates of a current level (RobustDetLvl, FastDetLvl) of feedback. In the embodiment of FIG. 3A, the controller (CTR) is configured to control the feedback reduction unit (FBRU) via control signal FBRctr, e.g. its activation and/or deactivation, and/or properties of the applied gain pattern, e.g. its level and/or distribution in frequency bands.

Figure 3B:
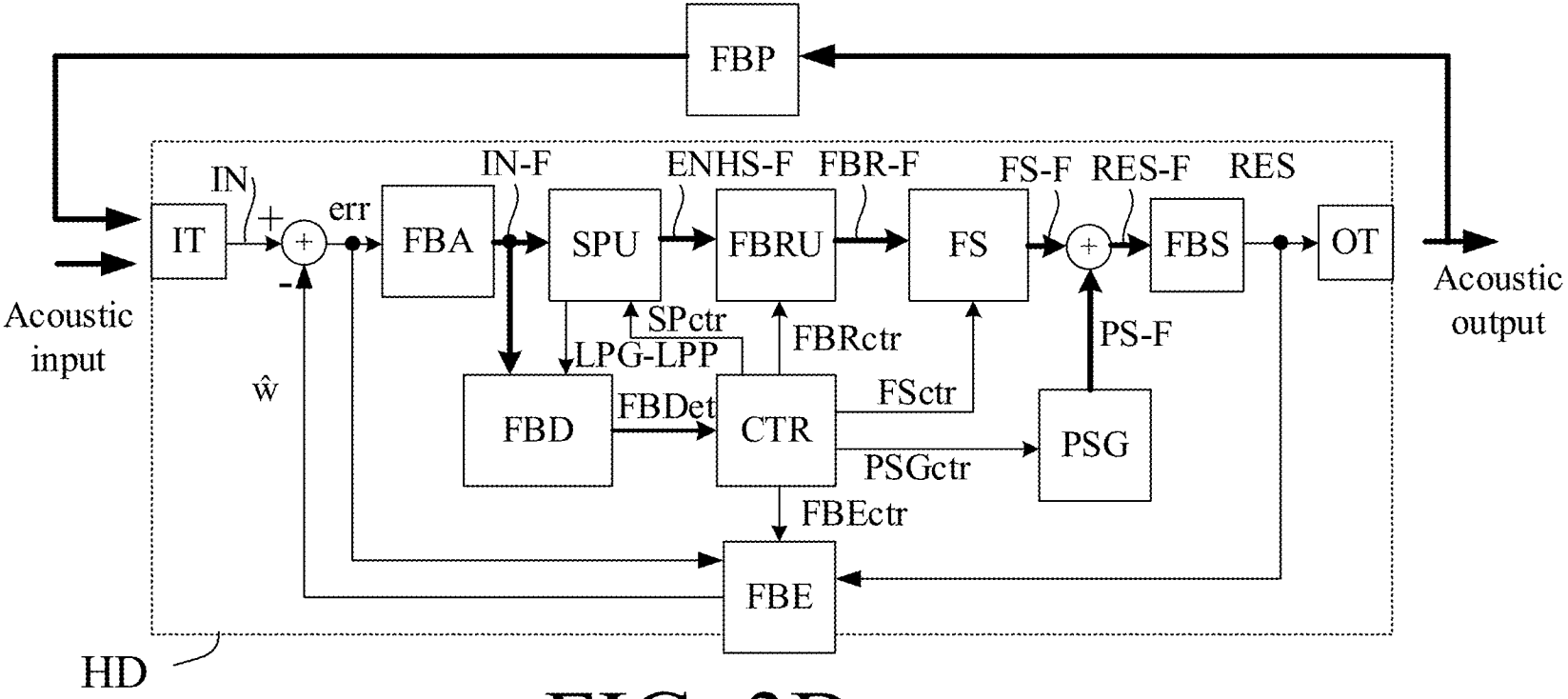
FIG. 3B shows a fifth embodiment of a hearing device comprising a feedback detector according to the present disclosure.

FIG. 3B shows a further embodiment of a hearing device (HD), e.g. a hearing aid, comprising a feedback detector (FBD) according to the present disclosure. The embodiment of FIG. 3B comprises the same functional elements as the embodiment of illustrated in FIG. 3A. In addition, the embodiment of FIG. 3B comprises a feedback reduction system comprising feedback estimation units FBE, and combination unit '+' (as also illustrated and discussed in connection with FIGS. 1B, 1C). In certain modes of operation, the feedback reduction system is configured to estimate the feedback path (cf. signal $\hat{w}$) and to subtract the estimate of the feedback path from the electric input signal IN (in combination unit '+') providing a feedback compensated input signal err, which is fed to the analysis filter bank (FBA) (and from there to the signal processor (SPU) of the forward path) and to the feedback estimation unit (FBE). The feedback compensation is illustrated to be performed in the time domain, but may alternatively be performed in the time-frequency domain (by appropriately positioning analysis and synthesis filter banks (FBA, FBS)).

The embodiment of FIG. 3B further comprises a decorrelation unit for de-correlating the input signal (IN) from the output signal (RES). In the embodiment of FIG. 3B, the decorrelation unit is embodied in a frequency shift unit (FS) for introducing a (small, e.g. $\Delta f \leq 10$ Hz) frequency shift $\Delta f$ in the forward path (here applying the frequency shift to signal FBR-F from the feedback reduction unit (FBRU) and providing frequency shifted signal FS-F, which is fed to combination unit '+'). Other de-correlating means may be applied, such as phase changes, time delay changes, frequency specific level changes, etc., e.g. depending on the system design, e.g. on the transformation domain (e.g. time domain or frequency domain).

The embodiment of FIG. 3B further comprises a probe signal generator (PSG) for generating a probe signal (PS-F), e.g. a noise signal, such as a white noise signal, or other signal having a frequency spectrum that is (substantially) un-correlated with the input signal. In an embodiment, the probe signal is configured to have (substantial) content (magnitude) at frequency bands containing or expected to contain feedback.

The embodiment of FIG. 3B comprises controller (CTR) as in FIG. 3A. In FIG. 3B, the controller is configured to control additional functional units compared to the embodiment of FIG. 3A. In the embodiment of FIG. 3B, the controller receives a current estimate of loop magnitude (LPG, as in FIG. 3A) as well as loop phase (LPP, cf. discussion in connection with FIG. 5A, 5B below). The controller (CTR) may e.g. in general be configured to initiate one or more actions based on the feedback detection signal (FDet). Such actions may e.g. include one or more of a) reduction of gain, e.g. in the signal processor (SPU, cf. signal SPctr in FIG. 3B), e.g. a large gain reduction for a short time (e.g. for one or a few loop delays) as a first howl attenuating action, or b) otherwise modify an intended forward gain, e.g. by applying a modified gain pattern, e.g. via feedback reduction unit (FBRU, cf. signal FBRctr in FIG. 3B), or c) to modify an adaptation rate and/or an update frequency of the feedback estimation unit (FBE, cf. signal FBEctr in FIG. 3B), or d) application of a frequency shift $\Delta f$ (e.g. between 5 and 20 Hz) to a signal of the forward path, e.g. via the frequency shift unit (FS, cf. signal FSctr in FIG. 3B), or e) application of a probe signal, e.g. generated by the probe signal generator (PSG, cf. probe signal PS-F and control signal PSGctr, respectively, in FIG. 3B), to a signal of the forward path (here added to signal FS-F (via sum unit '+') and providing resulting signal RES-F), or f) frequency transposition, e.g. moving (relocating) or modifying (e.g. removing) frequency content from one or more frequency bands of a signal of the forward path, or g) notch filtering (attempting to attenuate frequencies where feedback howl is detected or is expected to occur), or h) half-wave rectification, etc.

In an embodiment, a combination of such actions are initiated (e.g. at different times) after a detection of feedback by the first and second detectors, respectively. In an embodiment, a combination of such actions are initiated simultaneously after a detection of feedback by the first and second detectors, respectively, while others are initiated sequentially in time. In an embodiment, a combination of actions comprises a combination of actions from a) and b). In an embodiment, a combination of actions comprises a combination of actions from a), b) and c). In an embodiment, a combination of actions comprises a combination of actions from a), b), c) and d). In an embodiment, a combination of actions comprises a combination of actions from a), b), c) and e).

Figure 4:
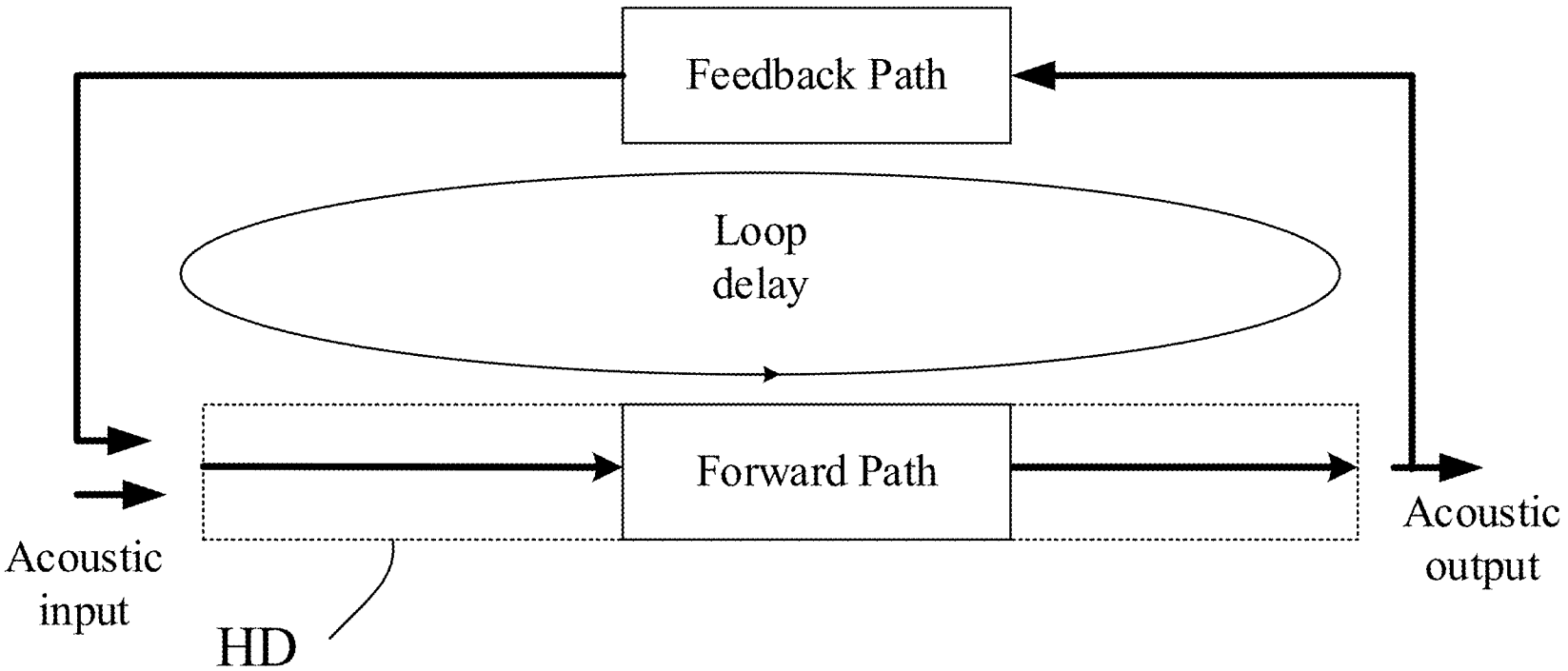
FIG. 4 shows the feedback loop of a hearing device comprising an electric forward path from input to output transducer, and an acoustic (and/or mechanical) feedback loop from output to input transducer, FIG. 5A schematically illustrates a loop phase versus time graph during build-up of feedback howl, and FIG. 5B schematically illustrates a feedback detection versus time graph during build-up and cancelling of feedback howl.

FIG. 4 shows the feedback loop of a hearing device comprising an electric forward path from input to output transducer, and an acoustic (and/or mechanical) feedback loop from output to input transducer.

Knowledge (e.g. an estimate or a measurement) of the length of one loop delay is assumed to be available.

The loop delay is defined as the time required for the signal travelling through the acoustic loop, as illustrated in FIG. 3. The acoustic loop consists of the forward path (FID), and the feedback path. The loop delay is taken to include the processing delay d of the (electric) forward path of the hearing device from input transducer to output transducer and the delay d' of the acoustic feedback path from the output transducer to the input transducer of the hearing device, LoopDelay D=d+d'.

Typically, the acoustic part d' of the loop delay is much less than the electric (processing) part d of the loop delay, d'<<d. In an embodiment the electric (processing) part d of the loop delay is in the range between 2 ms and 10 ms, e.g. in the range between 5 ms and 8 ms, e.g. around 7 ms. The loop delay may be relatively constant over time (and e.g. determined in advance of operation of the hearing device) or be different at different points in time, e.g. depending on the currently applied algorithms in the signal processing unit (e.g. dynamically determined (estimated) during use). The hearing device (HD) may e.g. comprise a memory unit wherein typical loop delays in different modes of operation of the hearing device are stored. In an embodiment, the hearing device is configured to measure a loop delay comprising a sum of a delay of the forward path and a delay of the feedback path. In an embodiment, a predefined test-signal is inserted in the forward path, and its round trip travel time measured (or estimated), e.g. by identification of the test signal when it arrives in the forward path after a single propagation (or a known number of propagations) of the loop.

Figure 5A:
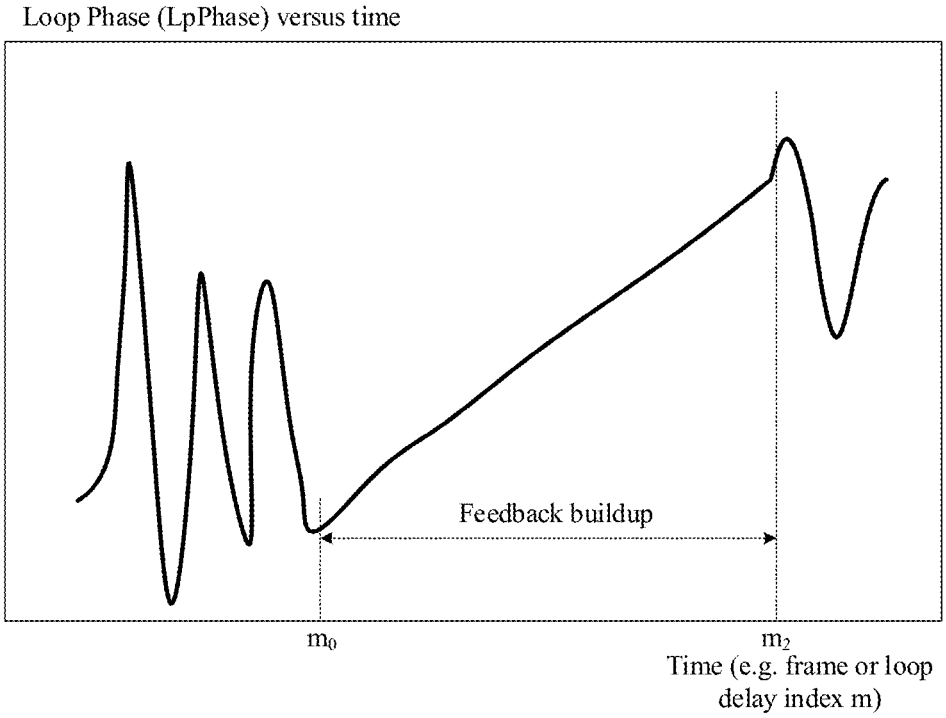

FIG. 5A shows a graph schematically illustrates loop phase (LpPhase) versus time (m, m being e.g. a time frame index, or a loop delay index) for a hearing device according to the present disclosure, including a time segment during which feedback howl builds up. In an embodiment, where a constant frequency shift Δf is applied to a signal of the forward path of the hearing device (cf. e.g. block FS in FIG. 3B), the loop phase increases with a constant (average) rate. Onset of feedback howl may thus e.g. be detected by monitoring a time derivative of an estimated loop phase (d/dt(LpPhase)). Feedback is assumed to be present, when the time derivative of the loop phase is (substantially) constant, as e.g. reflected by a constant value of the slope in the graph of loop phase versus time (cf. middle part of the graph in FIG. 5A, indicated by dotted arrow denoted 'Feedback build-up' (between time frame (or loop delay) indices $m_0$ and $m_2$ on the horizontal time axis). The schematic graph indicates a fairly linear increase of the loop phase with time between $m_0$ and $m_2$. In practice, the course may be deviate from a strictly linear course, e.g. be modulated by any corrective measures applied as a consequence of the feedback detection (cf. 'FBC-Action(s)', in FIG. 5B). Feedback can be assumed to be detected, when the time derivative (slope) of the estimated loop phase has been constant (e.g. equal to $2\pi\Delta f$) for a certain time period, e.g. for a certain number of time frames (or loop delays) $\Delta m_{fb}$, e.g. for more than 10 time frames (or loop delays), or a conditional criterion, e.g. x detections out of y frames (y>x, e.g. x>y/2, e.g. 6 out of 10). In the right part of the graph (for $t>m_2$), it is assumed that the feedback situation has changed to be less critical, and/or been taken care of by one or more actions in the hearing device (as e.g. discussed in connection with FIG. 3A, 3B), so that the loop phase resumes a normal variation. The estimated loop phase is an example of a feedback detection criterion (signal FbDetCrit) that can be used as input to the (Regular or $3^{rd}$) detector, as discussed in connection with FIG. 2. An onset of feedback howl build-up may be detected in the feedback detector FBD (e.g. in the Regular (or $3^{rd}$) detector of the embodiment of FIG. 2), and a detection signal based thereon (e.g. Det in FIG. 2) be used as input to the units determining the resulting feedback detection signal(s) FBDet (cf. Robust ($1^{st}$) and Fast ($2^{nd}$) detectors of the embodiment of FIG. 2). A detection signal based on loop phase is robust towards (false detection of) pure tones.

As mentioned, the increasing loop phase during feedback shown in FIG. 5A is not a general property. It is increasing linearly because we have applied frequency shift Δf (e.g. 10 Hz) in the forward path. In a more general example, without application of frequency shift. the course of loop phase during feedback may be constant (instead of increasing with $2\pi\Delta f/f_s$, where fs is the sampling frequency, e.g. 20 kHz, or a decimated sampling frequency, if applied in frequency sub-bands). Feedback detection should then be appropriately adapted. In an embodiment (without application of frequency shift Δf, e.g. in a specific mode of operation without frequency shift, e.g. in a music listening mode), the loop phase versus time is constant. In an embodiment, where an acoustic situation with "pure" feedback, i.e. a constant pure tone, is present, and where the resulting pure tone lies exactly on a sub-band center frequency of the filter bank, the loop phase versus time is constant and equal to zero. These two conditions are, however, rarely met because a) feedback is generally detected during build-up, i.e. long before it gets "pure" (and attempts to handle the feedback are initiated), and b) the howling frequency depends on the external feedback path and can vary over time (and thus rarely a "pure" tone).

In an embodiment, the hearing device is configured to provide that a variation of loop phase with time comprises specific characteristics that can be used for detecting feedback (or build-up of feedback). In an embodiment, such specific characteristics are a linearly increasing loop phase with time. Such characteristics may as mentioned above be implemented by a frequency shift unit in the forward path (cf. unit FS in FIG. 3B).

Figure 5B:
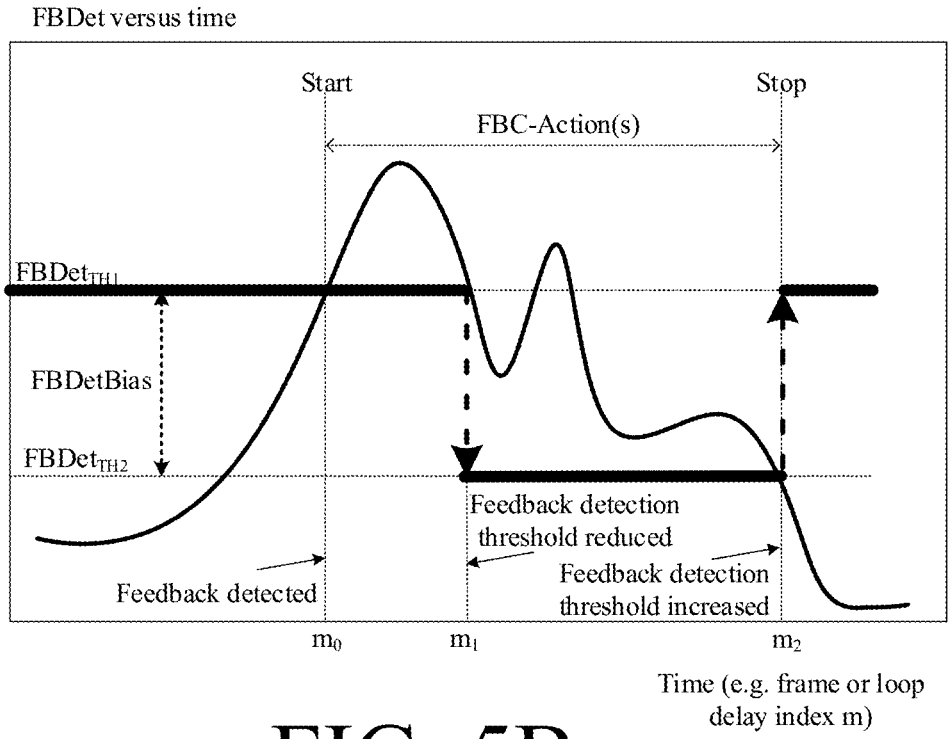

FIG. 5B schematically illustrates a feedback detection measure (FBDet) versus time (m) graph during build-up and cancelling of feedback howl. The feedback detection measure may e.g. represent an estimated level of feedback (e.g. RobustDetLvl or FastDetLvl in FIG. 2) or another parameter representative of a current amount of feedback. The graph illustrates a time variation of the feedback detection measure during build-up of feedback $t<m_0$ (reflected in increasing values of FBDet), feedback detection at $t=m_0$ (where the feedback detection measure FBDet becomes equal to and larger than a first threshold value $FBDet_{TH1}$), activation of one or more measures to cancel (reduce) feedback howl during $m_0<t<m_2$ (reflected in decreasing values of FBDet), and normal operation for $t>m_2$ (reflected in relatively low values of FBDet), where at least some of the specific feedback reducing activities are disabled. In the time period $m_0<t<m_2$, where one or more actions are activated, including, an action to cancel or reduce feedback in the input signal, the threshold for detecting feedback is modified to ensure that a feedback reducing activity is maintained until the situation is stabilized (e.g. reflected in that the feedback measure is constantly low (cf. $t>m_2$); e.g. not 'oscillating' (as schematically indicated in the time period $m_0<t<m_2$). In the schematic example of FIG. 5B, the threshold value for detecting feedback $FBDet_{TH}$ is decreased from the first (larger), default value $FBDet_{TH1}$ to a second (lower) value $FBDet_{TH2}$, when the value feedback detection measure FBDet decreases below the first value $FBDet_{TH1}$ (at time $m_1$). While the (or at least some of) the initiated actions are maintained. First when the value feedback detection measure FBDet decreases below the second value $FBDet_{TH2}$ (at time $m_2$), the (or at least some of) the initiated actions are disabled. Thereby a certain amount of hysteresis is introduced in the feedback detection and the consequently initiated feedback reduction process (to ensure that feedback is sufficiently dealt with (compensated or eliminated) before the cancellation measures are disabled). At time $m_2$, the threshold value for detecting feedback $FBDet_{TH}$ is increased (reset) from the second value $FBDet_{TH2}$ to the default value $FBDet_{TH}$.

Figure 6:
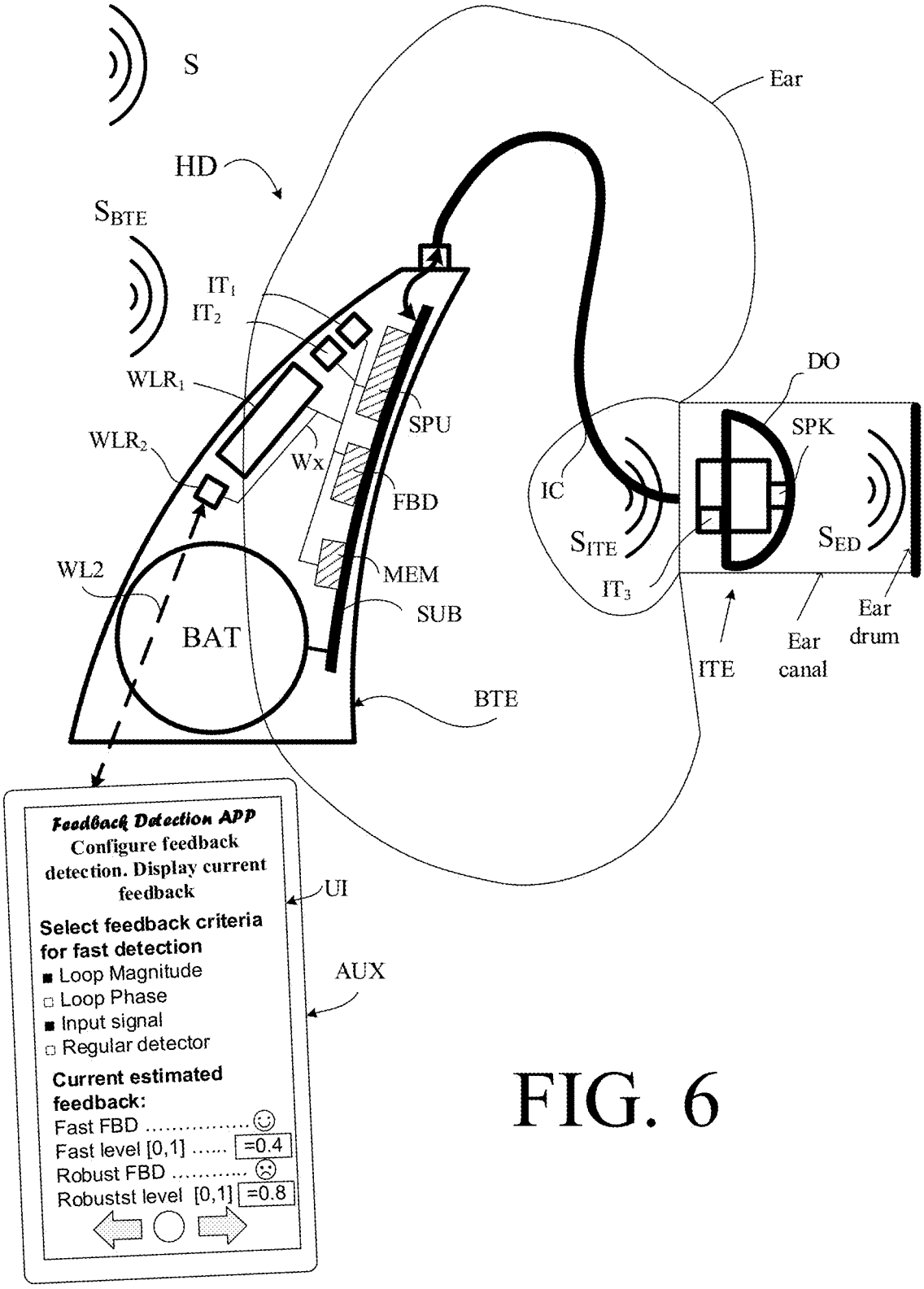
FIG. 6 shows an embodiment of a hearing system comprising a hearing device and an auxiliary device in communication with each other.

FIG. 6 shows an embodiment of a hearing system comprising a hearing device and an auxiliary device in communication with each other. FIG. 6 shows an embodiment of a hearing aid according to the present disclosure comprising a BTE-part located behind an ear or a user and an ITE part located in an ear canal of the user.

FIG. 6 illustrates an exemplary hearing aid (HD) formed as a receiver in the ear (RITE) type hearing aid comprising a BTE-part (BTE) adapted for being located behind pinna and a part (ITE) comprising an output transducer (e.g. a loudspeaker/receiver, SPK) adapted for being located in an ear canal (Ear canal) of the user (e.g. exemplifying a hearing aid (HD) as shown in FIG. 1A, 1B or 1C). The BTE-part (BTE) and the ITE-part (ITE) are connected (e.g. electrically connected) by a connecting element (IC). In the embodiment of a hearing aid of FIGS. 1A-1C, the hearing device (HD) comprises one input transducer (here a microphone) (IT) for providing an electric input audio signal y representative of an input sound signal (Acoustic input) from the environment (comprising a mixture of an external signal x and a feedback signal w). In the embodiment of a hearing aid of FIG. 6, the BTE part (BTE) comprises two input transducers (here microphones) ($IT_1$, $IT_2$) each for providing an electric input audio signal representative of an input sound signal ($S_{BTE}$) from the environment. In the scenario of FIG. 6, the input sound signal $S_{BTE}$ includes a contribution from an external sound source S. The hearing aid of FIG. 6 further comprises two wireless receivers ($WLR_1$, $WLR_2$) for providing respective directly received auxiliary audio and/or information signals. The hearing aid (HD) further comprises a substrate (SUB) whereon a number of electronic components are mounted, functionally partitioned according to the application in question (analogue, digital, passive components, etc.), but including a configurable signal processing unit (SPU), a feedback detector (FBD), and a memory unit (MEM) coupled to each other and to input and output transducers via electrical conductors Wx. The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processing unit (SPU) provides an enhanced audio signal, which is intended to be presented to a user. In the embodiment of a hearing aid device in FIG. 6, the ITE part (ITE) comprises an output unit in the form of a loudspeaker (receiver) (SPK) for converting the electric signal (OUT) to an acoustic signal (providing, or contributing to, acoustic signal $S_{ED}$ at the ear drum (Ear drum)). In an embodiment, the ITE-part further comprises an input unit comprising an input transducer (e.g. a microphone) ($IT_3$) for providing an electric input audio signal representative of an input sound signal Srrr from the environment (including from sound source S) at or in the ear canal. In another embodiment, the hearing aid may comprise only the BTE-microphones ($IT_1$, $IT_2$). In another embodiment, the hearing aid may comprise only the ITE-microphone ($IT_3$). In yet another embodiment, the hearing aid may comprise an input unit ($IT_4$) located elsewhere than at the ear canal in combination with one or more input units located in the BTE-part and/or the ITE-part. The ITE-part further comprises a guiding element, e.g. a dome, (DO) for guiding and positioning the ITE-part in the ear canal of the user.

The hearing aid (HD) exemplified in FIG. 6 is a portable device and further comprises a battery, e.g. a rechargeable battery, (BAT) for energizing electronic components of the BTE- and ITE-parts.

The hearing aid (HD) may e.g. comprise a directional microphone system (e.g. a beam former filtering unit) adapted to spatially filter a target acoustic source (e.g. a localized, e.g. speech sound source) among a multitude of acoustic sources in the local environment of the user wearing the hearing aid device. In an embodiment, the directional system is adapted to detect (such as adaptively detect) from which direction a particular part of the microphone signal (e.g. a target part and/or a noise part) originates. In an embodiment, the beam former filtering unit is adapted to receive inputs from a user interface (e.g. a remote control or a smartphone) regarding the present target direction. The memory unit (MEM) may e.g. comprise predefined (or adaptively determined) complex, frequency dependent constants ($W_{ij}$) defining predefined or (or adaptively determined) 'fixed' beam patterns (e.g. omni-directional, target cancelling, etc.), together defining a beamformed signal $Y_{BF}$.

The hearing aid of FIG. 6 may constitute or form part of a hearing aid and/or a binaural hearing aid system according to the present disclosure. The hearing aid comprises a feedback detector, and or a feedback cancellation system as described above. The processing of an audio signal in a forward path of the hearing aid may e.g. be performed fully or partially in the time-frequency domain. Likewise, the processing of signals in an analysis or control path of the hearing aid may be fully or partially performed in the time-frequency domain.

The hearing aid (HD) according to the present disclosure may comprise a user interface UI, e.g. as shown in FIG. 6 implemented in an auxiliary device (AUX), e.g. a remote control, e.g. implemented as an APP in a smartphone or other portable (or stationary) electronic device. In the embodiment of FIG. 6, the screen of the user interface (UI) illustrates a Feedback Detection APP, with the subtitle 'Configure feedback detection. Display current feedback' (upper part of the screen). Criteria for detecting feedback can be configured by the user via the APP (middle part of screen denoted 'Select feedback criteria for fast detection'). The feedback criteria (inputs to the feedback detector, on which the estimates of the feedback situation are based) can be selected between a number of criteria, here between 'Loop Magnitude', 'Loop Phase', 'Input signal' and 'Regular detector' (the latter being equivalent to the use of a $3^{rd}$ binary indication of feedback as input). In the screen shown in FIG. 6, criteria 'Loop Magnitude' and 'Input signal' have been selected (as indicated by solid symbols ■). This means that the inputs to the feedback detector are the current closed loop magnitude and the electric input signal (from the input transducer). The current feedback situation determined using the selected criteria is displayed (lower part of screen, denoted 'Current estimated feedback'). With reference to FIG. 2, the Fast FBD and Robust FBD parameters are binary indicators of fast and robust feedback, respectively (corresponding to $2^{nd}$ and $1^{st}$ binary indications of feedback) value between 0 and 1 is used to indicate a degree of severity of the current feedback (overall, although possibly determined on a frequency sub-band level). The legend is indicated as OK (☺) for values of the level of feedback below 0.5 and as critical (☹) for values of the level of feedback above 0.5. The current value of the 'fast level of feedback' is indicated as '=0.4' (and hence the OK (☺) for the binary Fast FBD parameter). The current value of the 'robust level of feedback' is indicated as '=0.8' (and hence the not OK (☹) for the binary Robust FBD parameter). Such estimates of the feedback situation may be interpreted as a situation where a feedback cancellation system should be (remain) active although the present feedback situation (provided by the Fast MD-parameter indicates no significant feedback. The reaction to the resulting parameter values is e.g. controlled by a controller (e.g. unit CTR in FIG. 3) according to a predefined scheme. The arrows at the bottom of the screen allow changes to a preceding and a proceeding screen of the APP, and a tab on the circular dot between the two arrows brings up a menu that allows the selection of other APPs or features of the device. In an embodiment, the APP is configured to provide an (possibly graphic) illustration of the current feedback detection (e.g. signal FBDet(k,m)) on a frequency sub-band level, e.g. relative to a current feedback margin (k and m being frequency and time indices, respectively).

The auxiliary device and the hearing aid are adapted to allow communication of data representative of the currently selected direction (if deviating from a predetermined direction (already stored in the hearing aid)) to the hearing aid via a, e.g. wireless, communication link (cf. dashed arrow WL2 in FIG. 6). The communication link WL2 may e.g. be based on far field communication, e.g. Bluetooth or Bluetooth Low Energy (or similar technology), implemented by appropriate antenna and transceiver circuitry in the hearing aid (HD) and the auxiliary device (AUX), indicated by transceiver unit $WLR_2$ in the hearing aid.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP3139636A1 (Oticon, Bernafon) Aug. 3, 2017
EP2217007A1 (Oticon) Nov. 8, 2010
EP3291581A2 (Oticon) Jul. 3, 2018

The invention claimed is:

1. A hearing device comprising an input transducer for providing an electric input signal representative of a sound in the environment of the hearing device, an output transducer for providing an output sound representative of said electric input signal, and a signal processor operationally connected to the input and output transducers, and forming part of an electric forward path for processing said electric input signal and providing a processed electric output signal, a feedback detector for providing first and second indications of current feedback in an external—acoustic and/or mechanical—feedback path from said output transducer to said input transducer, wherein the feedback detector comprises first and second detectors for providing said first and second indications of current feedback, respectively, based on said electric input signal or a processed version thereof, and wherein said first and second indications of current feedback are generated with first and second time constants, respectively, and where the first time constant is larger than the second time constant, and wherein a detection of feedback by the second detector triggers activation of the first detector.

2. A hearing device according to claim 1 configured to provide that either the first indication of current feedback or the second indication of current feedback is active or actively used at a given point in time.

3. A hearing device according to claim 1 comprising an open loop gain estimator configured to determine a current open loop magnitude of a feedback loop defined by said forward path and said external feedback path and to determine said first and/or second indications of current feedback, respectively, based on said electric input signal or a processed version thereof and on said current open loop magnitude.

4. A hearing device according to claim 3 wherein the open loop gain estimator is configured to determine the current open loop magnitude at time instant m as $$Lp\mathrm{Mag}(k,m)=\mathrm{Mag}(k,m)-\mathrm{Mag}(k,m_D),$$

where Mag(k,m) is the magnitude value of the electric input signal IN(k,m) or another signal of the forward path at time m, whereas $\mathrm{Mag}(k,m_D)$ denotes the magnitude of the electric input signal $\mathrm{IN}(k,m_D)$ one feedback loop delay D earlier.

5. A hearing device according to claim 3 wherein said first and second detectors are configured to provide said first and second indications of current feedback, respectively, based on a first input comprising said electric input signal or a processed version thereof, and on a second input comprising said current open loop magnitude of a feedback loop defined by said forward path and said external feedback path.

6. A hearing device according to claim 5 wherein the feedback detector comprises a third detector for providing a third binary indication of current feedback based on said electric input signal or a signal derived therefrom, and wherein said first input to said first and second detectors comprises said third binary indication of current feedback.

7. A hearing device according to claim 5 wherein said first detector comprises a processor configured to smooth said first input comprising said electric input signal or a processed version thereof over time/and or frequency and to provide said first binary indication of feedback based thereon.

8. A hearing device according to claim 3 wherein said second detector is configured to provide said second indication of current feedback based on a first input comprising said electric input signal or a processed version thereof, a second input comprising said current open loop magnitude of a feedback loop defined by said forward path and said external feedback path, and a third input received from the first detector and being indicative of a confidence level of the first binary indication of current feedback.

9. A hearing device according to claim 1 wherein said first and/or second indications of current feedback, respectively, comprise first and/or second binary indications of current feedback.

10. A hearing device according to claim 1 wherein said first and/or second indications of current feedback, respectively, comprise first and second estimates of a current level of feedback.

11. A hearing device according to claim 1 wherein said feedback detector comprises a processor for determining an accumulated loop magnitude over time and/or frequency in dependence of said current open loop magnitude.

12. A hearing device according to claim 11 wherein said second detector is configured to determine said second estimate of a current level of feedback in dependence of said accumulated loop magnitude.

13. A hearing device according to claim 11 wherein said feedback detector comprises a processor for smoothing said accumulated loop magnitude over time and/or frequency and providing a smoothed accumulated loop magnitude.

14. A hearing device according to claim 13 wherein said first detector is configured to determine said first estimate of a current level of feedback in dependence of said smoothed accumulated loop magnitude.

15. A hearing device according to claim 1 comprising a controller configured to control functionality of the hearing device based on or influenced by the first and second binary indications of current feedback and/or by the first and second estimates of a current level of feedback.

16. A hearing device according to claim 1 constituting or comprising a hearing aid, a headset, an earphone, an ear protection device, a speakerphone or a combination thereof.

17. A hearing device comprising an input transducer for providing an electric input signal representative of a sound in the environment of the hearing device, an output transducer for providing an output sound representative of said electric input signal, and a signal processor operationally connected to the input and output transducers, and forming part of an electric forward path for processing said electric input and providing a processed electric output signal, a feedback detector for providing first and second indications of current feedback in an external—acoustic and/or mechanical—feedback path from said output transducer to said input transducer, wherein the feedback detector comprises first and second detectors for providing said first and second indications of current feedback, respectively, based on said electric input signal or a processed version thereof, and wherein said first and second indications of current feedback are generated with first and second, and wherein activation of the first detector disables the second detector.

18. A hearing device comprising an input transducer for providing an electric input signal representative of a sound in the environment of the hearing device, an output transducer for providing an output sound representative of said electric input signal, and a signal processor operationally connected to the input and output transducers, and forming part of an electric forward path for processing said electric input signal and providing a processed electric output signal, a feedback detector for providing first and second indications of current feedback in an external—acoustic and/or mechanical—feedback path from said output transducer to said input transducer, a controller configured to control functionality of the hearing device based on or influenced by the first and second binary indications of current feedback and/or by the first and second estimates of a current level of feedback, wherein the feedback detector comprises first and second detectors for providing said first and second indications of current feedback, respectively, based on said electric input signal or a processed version thereof, and wherein said first and second indications of current feedback are generated with first and second, and wherein the controller is configured to provide that a detection of feedback by the first and second detectors trigger activation of respective first and second, different kinds of feedback handling actions, wherein the second kind of feedback handling actions are configured to have a larger and/or faster impact on reducing the feedback and/or on reducing the respective indication of current feedback than the first kind of feedback handling actions.

19. A method of detecting feedback in a hearing device, the hearing device comprising an input transducer for providing an electric input signal representative of a sound in the environment of the hearing device, an output transducer for providing an output sound representative of said electric input signal, and a signal processor operationally connected to the input and output transducers, and forming part of an electric forward path for processing said electric input signal and providing a processed electric output signal, the method comprising providing using a feedback detector, first and second binary indications of current feedback in an external—acoustic and/or mechanical—feedback path from said output transducer to said input transducer, determining, using first and second detectors of said feedback detector, first and second indications of current feedback, respectively, based on said electric input signal or a processed version thereof, wherein said first and second binary indications of current feedback are generated with first and second time constants, respectively, where the first time constant is larger than the second time constant, wherein detection of feedback by the second detector triggers activation of the first detector.

20. A hearing device comprising an input transducer for providing an electric input signal representative of a sound in the environment of the hearing device, an output transducer for providing an output sound representative of said electric input signal, and a signal processor operationally connected to the input and output transducers, and forming part of an electric forward path for processing said electric input signal and providing a processed electric output signal, a feedback detector for providing first and second indications of current feedback in an external—acoustic and/or mechanical—feedback path from said output transducer to said input transducer, wherein the feedback detector comprises first and second detectors for providing said first and second indications of current feedback, respectively, based on said electric input signal or a processed version thereof, and wherein said first and second indications of current feedback are generated with first and second time constants, respectively, and where the first time constant is larger than the second time constant, and wherein the output of the second detector is used as an input to the first detector.

21. A method of detecting feedback in a hearing device, the hearing device comprising an input transducer for providing an electric input signal representative of a sound in the environment of the hearing device, an output transducer for providing an output sound representative of said electric input signal, and a signal processor operationally connected to the input and output transducers, and forming part of an electric forward path for processing said electric input signal and providing a processed electric output signal, the method comprising providing, using a feedback detector, first and second binary indications of current feedback in an external—acoustic and/or mechanical—feedback path from said output transducer to said input transducer, determining, using first and second detectors of said feedback detector, first and second indications of current feedback, respectively, based on said electric input signal or a processed version thereof, wherein said first and second binary indications of current feedback are generated with first and second time constants, respectively, where the first time constant is larger than the second time constant, wherein the output of the second detector is used as an input to the first detector.

* * * * *